United States Patent [19]

Anderson

[11] Patent Number: 4,567,803

[45] Date of Patent: Feb. 4, 1986

[54] SAFETY SAW CHAIN

[76] Inventor: Roy H. Anderson, 1701 90th Ave. NE., Bellevue, Wash. 98004

[21] Appl. No.: 555,604

[22] Filed: Nov. 28, 1983

Related U.S. Application Data

[63] Continuation-in-part of Ser. No. 516,125, Jul. 20, 1983, abandoned.

[51] Int. Cl.[4] ..... B27B 33/14

[52] U.S. Cl. ..... 83/833; 83/834

[58] Field of Search ..... 83/833, 834

[56] References Cited

U.S. PATENT DOCUMENTS

| | | | |
|---|---|---|---|
| 1,150,218 | 8/1915 | Martin . | |
| 2,771,919 | 11/1956 | Cox . | |
| 2,832,380 | 4/1958 | Crowe. | |
| 2,857,942 | 10/1958 | Mall . | |
| 3,224,476 | 12/1965 | Chadwick | 83/834 |
| 3,346,025 | 7/1966 | Anderson et al. . | |
| 3,543,817 | 12/1970 | Anderson | 83/833 |
| 3,735,662 | 5/1973 | Anderson | 83/830 |
| 3,745,870 | 7/1973 | Lemery | 83/833 |

FOREIGN PATENT DOCUMENTS

| | | | |
|---|---|---|---|
| 199854 | 9/1958 | Austria | 83/834 |

OTHER PUBLICATIONS

*Chain Saw Age,* vol. 29, No. 4, 10/1980 p. 6 "Windsor in Unique Position to Innovate".

*Chain Saw Age,* vol. 31, No. 10, 4/1983 p. 30 "Stihl Unveils Low-Kick and Ripping Chain Designs".

*Chain Saw Age,* vol. 31, No. 10, 4/1983 p. 28 Advertisement for Low-Kickback Chain.

*Primary Examiner*—James M. Meister

*Attorney, Agent, or Firm*—Dowrey & Cross

[57] ABSTRACT

An anti-kickback saw chain having a drop-away articulated depth gauge link preceeding each cutting or fibre removing link in a link sequence utilizing V-shaped cutter tooth links, each followed by a generally L-shaped raker tooth link. The depth gauge surface of the depth gauge link is spaced forwardly of the cutting tooth and the trailing edge thereof is located aft of the pivotal connection with the cutting tooth link when the pivot points of the links are aligned. The depth gauge link is designed to maintain cutting efficiency on the bar nose and to "drop away" from the kerf when an obstruction is encountered and to initiate a depth gauge restoring action with the associated cutting tooth so as to avoid jamming or locking of the chain and attendant kickback.

22 Claims, 7 Drawing Figures

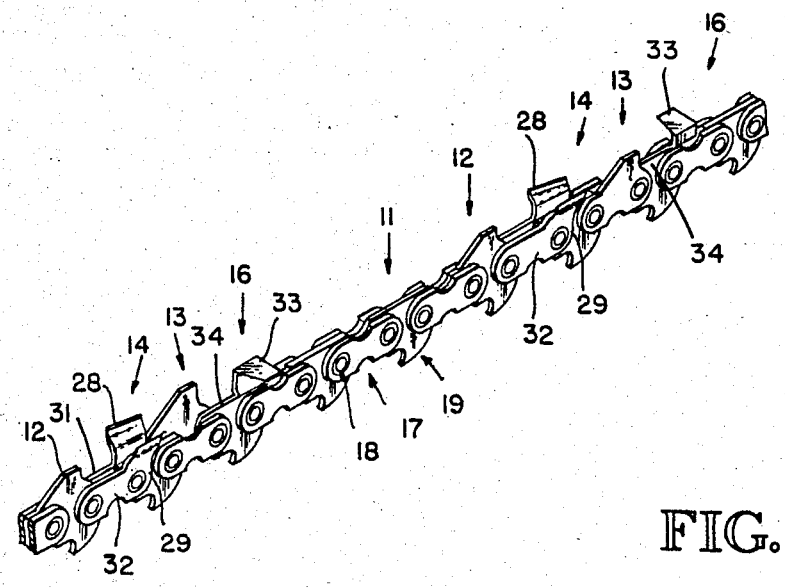
FIG. 1
FIG. 2
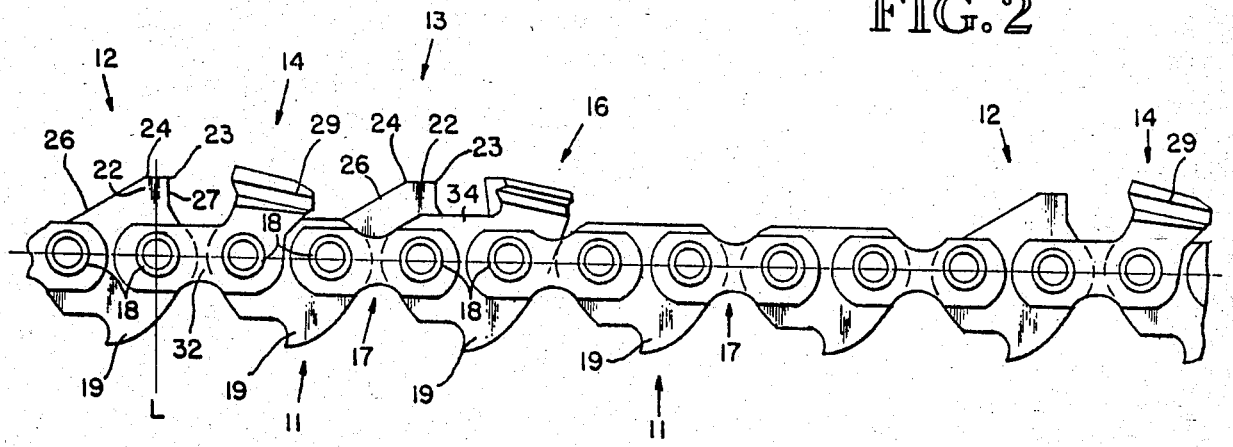

SAFETY SAW CHAIN

This application is a continuation-in-part of my copending application Ser. No. 516,125, filed July 20, 1983, now abandoned.

FIELD OF THE INVENTION

The present invention relates to the field of chain saws and in particular to anti-kickback cutting chains for use on chain saws.

DESCRIPTION OF THE PRIOR ART

Chain saws are provided with a guide bar on which the cutting chain is mounted. In operation, the chain moves away from the operator across the top of the guide bar in a substantially straight or linear run, is drawn around the radius or nose on the outboard end of the bar and returns toward the operator along the underside of the bar in a second linear run. Drive for the chain is provided by a drive sprocket about which the chain is trained and which is powered by a prime mover, such as an internal combustion engine, electric motor or other motor means such as compressed air for example. Various ones of the links of the cutting chain include cutting elements which extend outwardly from the chain when it is mounted on the guide bar.

Increasing attention has been focused on chain saw safety owing to the number and severity of injuries to chain saw operators, both amateur and professional. This concern is heightened by the fact that chain saw sales to non-professional users have increased dramatically in the past several years. A major cause of serious chain saw injuries relates to the phenomenon known as "kickback". Kickback occurs when the chain traversing the upper portion of the nose of the guide bar digs excessively into the wood or "snags" as may occur, for example, on encountering a split or knot in the wood or when limbing with the nose of the bar. Kickback of varying degrees may also be experienced when initiating a "boring" cut into the wood surface with the nose of the guide bar. Under these conditions the relationship between the cutting tooth, depth gauge and wood surface may cause the tooth to dig excessively into the uncut surface. When this occurs, the chain is momentarily stopped and the energy of the moving chain is transferred so as to propel the guide bar and moving chain upward toward the head and shoulders of the operator. During kickback, the operator can lose his grip on the forward handle allowing his hand or arm to engage the rotating cutter chain. The kickback may also operate to propel the saw bar in the opposite direction. A severe kickback or kickback coupled with loss of grip can result in the operating chain saw being thrown back into contact with the operator causing extremely serious injury.

The primary cause of chain jamming and locking and the resulting "kickback" is the fact that the present day depth gauges used to limit the cutting depth of a cutter tooth or a raker tooth either become ineffective, or are caused themselves to dig into the wood. If the depth gauge becomes ineffective when a knot or other obstacle is encountered, a crack or split occurs in the wood or for some other reason, the associated cutter or raker tooth is allowed to "dig in" and halt rotation of the chain. It is well appreciated in the art that, although a depth gauge setting on conventional saw chains may be designed for safe and efficient removal of chips over the top or bottom linear runs of the saw bar, the chain looses its cutting efficiency in the area of the nose because the effective difference between the height of the depth gauge and the cutter or raker tooth is severely lessened due to the curvature of the kerf. As a result, the chain will not "bore", i.e., cut with the nose or radius of the chain bar, without substantial increased pressure being applied by the operator. The use of the nose of the chain is also important for specialty work such as "limbing", an essential operation for the professional logger. The problem created for the professional is especially acute since his production level may depend on the "boring" and "limbing" efficiency of the saw as well as straight cutting. In the past, the solution for the dilemma of the professional has been to simply file down the depth gauge to obtain the desired efficiency for boring or limbing, leaving the chain extremely "hungry" when straight cutting. The term "hungry" indicates that the cutting depth of the cutter and raker teeth is far beyond the safety design range for the chain, enhancing the chances of kickback on straight cutting. Operating a hungry chain also results in a rough cutting action which significantly increases chain saw vibration. One well recognized hazard to the professional operator is the development of a condition commonly known in the trade as "white fingers" and technically described as chronic occupational occlusive arterial disease of the hands and fingers, *Peripheral Vascular Diseases,* Allen Barker & Hines, third edition, published by W. B. Saunders and Co. Persistent pain, coldness and discoloration of the fingers may develop after a period of years and in some cases the disease may produce permanent physical impairment requiring the patient to discontinue his occupation. Since the present chain need not be made to run hungry, the chain maintains its smoothness and the problem may be alleviated. Other mechanical problems resulting from chain vibration include saw bar overheating and wear as well as engine deterioration.

One approach to overcoming this safety hazard has been the use of a chain brake which stops rotation of the chain around the guide bar when kickback occurs. Many types of guards and external attachments such as nose guards to prevent the use of the chain for "boring" have been introduced for increased safety. The common approach of both professional and amateur is to immediately remove these devices to regain operating efficiency. Another approach to prevention of kickback-related injuries is the provision of a chain which has a reduced tendancy to dig in and jam. Such chains may include additional guard links or the like preceding a cutting link. In addition, the cutting link may include an integral depth gauge extending from the cutting link at a position ahead of the cutter. One of the problems with this solution is that the additional material or bulk of the chain tends to block chip flow resulting in clogging and again, efficiency is lost. Although such chains have helped reduce kickback-related injuries, such injuries with prior art chains remain unacceptably common and the number of injuries increases with the increased number of chain saws in use today. Productivity is the essence of professional chain saw use. Although all professional loggers endorce safety and opt for reduced workman's insurance premiums, if loss of productive revenue equals or exceeds the cost of insurance the use of safety devices will never be willingly accepted.

SUMMARY OF THE INVENTION

The cutting chain of the present invention dramatically reduces the kickback tendancy of chain saws. This saw chain includes two kinds of cutting links for optimum cutting efficiency; V-shaped cutter tooth links and generally L-shaped raker tooth links. In the preferred embodiments, cutter and raker tooth links are each immediately preceeded by a combined guard and depth gauge link. The saw chain may thus be formed of a combined guard-depth gauge link followed by a cutter link, a spacer link, another combined guard-depth gauge link, and a raker tooth link. The direction of the L-shaped raker tooth and the side link mounting of the associated depth gauge is reversed in successive cutting sequences to achieve lateral balance to the rotating chain. One or more spacer links may be interposed between such successive cutting segments as desired to obtain the desired chip flow capacity.

The combined guard-depth gauge link which preceeds each cutter and raker link is so formed and connected to cooperate with the associated cutting link as to reduce chain saw kickback. This dual function depth gauge link is so designed that its upper portion, which limits the depth of penetration of the cutting chain into the wood, actually "drops" or breaks away when an obstruction is encountered instead of digging in as conventional depth gauges do. Because of its articulated connection with the adjacent cutter or raker link an upsetting moment is applied to the cutter or raker link which results in pivoting it in a manner that forces the depth gauge to return to its original position to prevent the cutting tooth from digging in, thus avoiding jamming of the chain.

The geometry of the break away-articulated depth gauge link and connected cutter or raker link, set at a nominal clearance of seventeen thousands of an inch, is such that the cutting ability of the chain is retained at the nose or radius of the bar thus eliminating the need to file the depth gauges below safe levels in order to "bore" or "limb". Because it is not necessary to file down the depth gauges, the chain does not run "hungry" on the straight run and hence excessive vibration and the problem attendant thereto are alleviated.

Although the illustrated preferred saw chain configuration utilizes V-shaped cutter teeth and a chisel bit raker tooth, in its broadest scope, the present invention contemplates the combination of the novel depth gauge with any known design of cutter, raker or slitter teeth. For the purpose of the present invention, the term cutting tooth will be understood to include cutters, rakers, slitters or any other tooth designed to cut or remove fibre.

BRIEF DESCRIPTION OF THE DRAWINGS

FIG. 1 is a perspective view of a section of saw chain according to the present invention;

FIG. 2 is a side elevational view of a section of saw chain according to the present invention illustrating the links along a linear run of the chain;

DESCRIPTION OF PREFERRED EMBODIMENTS

Figures 3, 4:
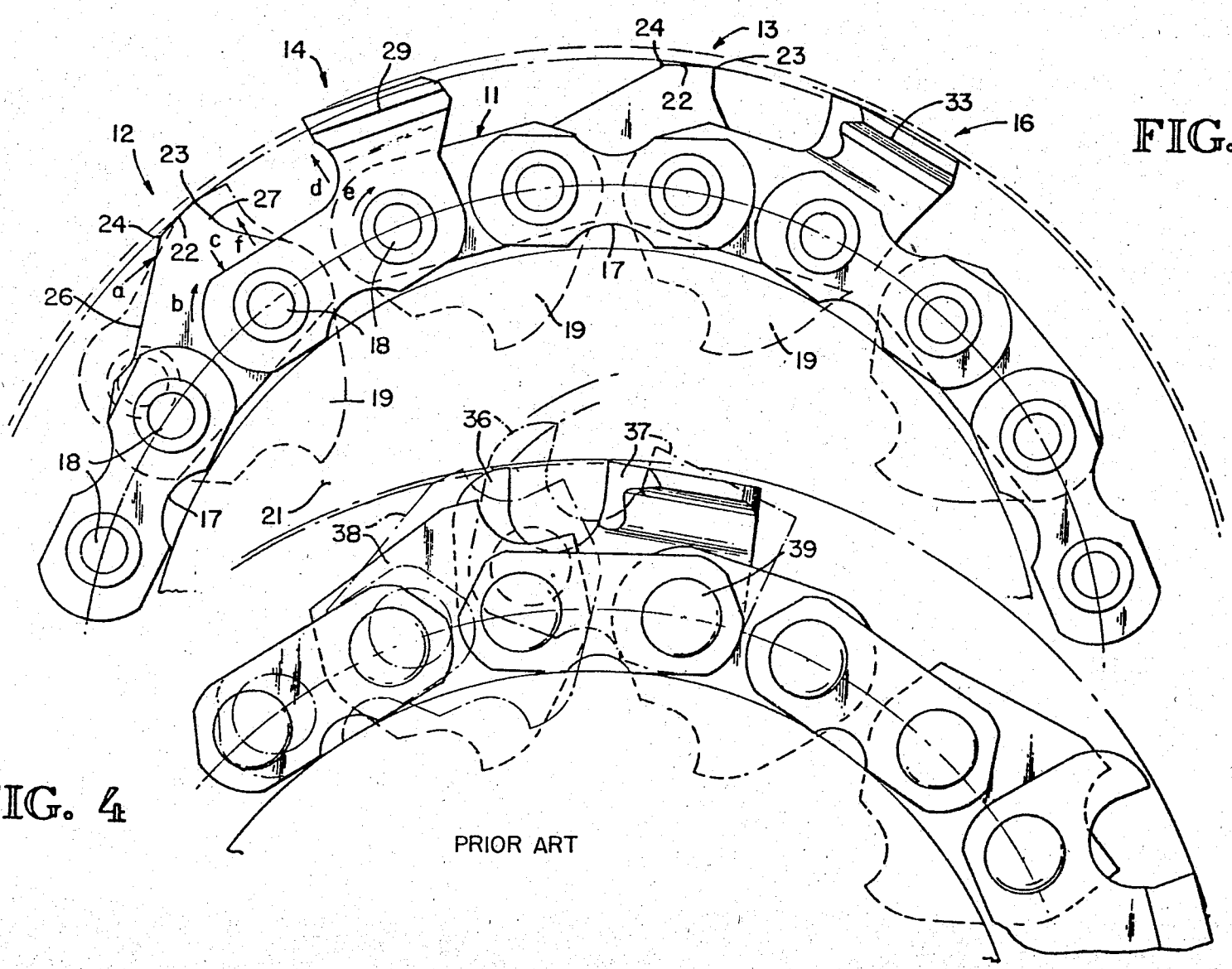
FIG. 3 is a side elevational view of a section of saw chain according to the present invention illustrating the configuration of the links as they pass around the nose of the chain guide bar.
FIG. 4 is a side elevational view of a section of a prior art saw chain illustrating the configuration of the links as they pass around the nose of the chain guide bar.

FIG. 1 illustrates a full sequence of links forming a segment of one preferred embodiment of the saw chain of the present invention. It will be understood that such sequence is repeated in the order and arrangement shown throughout the length of the chain. The saw chain includes center mounted spacer links 11, center mounted depth gauge links 12, side mounted depth gauge links 13, side mounted cutter links 14, center mounted raker links 16, and side connector links 17. Each of the center links 11, 12 and 16 comprises a single link element which is pivotally connected adjacent its ends to pairs of side link elements which form the adjacent side links. The center and side links are fastened together by rivets 18 which extend through both the side link elements and center link. Each center link, regardless of its function includes a conventional depending sprocket engaging drive tooth 19 which extends into a slot in the guide bar 21 as shown in FIG. 3 and engages the drive sprocket of the chain saw.

The center mounted spacer links 11 serve to increase the distance between successive cutter and raker links 14, 16 and to space successive segments containing cutter and raker links 14, 16 from one another. The number of spacer links between segments may be varied within well known limits to attain the desired chip flow for any given chain.

The depth gauge links determine the depth of penetration of the chain into the wood. A depth gauge link 12 or 13 is positioned immediately ahead of each cutter and raker link 14, 16 respectively to prevent such link from taking an excessively deep cut and binding in the wood. Although the links 12 are center links and the links 13 are side links, their general configuration and functions as depth gauges are identical and herein reference will be made to the link 12 for the sake of clarity with the understanding that the description applies equally well to both types of links. As illustrated in FIGS. 1–3, the upper surface of the depth gauge links 12 which contacts the bottom of the saw kerf is provided with an elongated and substantially flat top surface 22. In the embodiment of the chain illustrated in FIGS. 1–3, the extent of the flattened top surface 22 may be approximately 1/10" in length. This distance, however, may be varied without departing from the scope of the invention. As viewed most clearly in FIG. 2, when the chain is in a linear configuration with the centers of the rivets 18 aligned, the line L passing through the associated rivet center and normal to the line passing through the rivet centers of the chain preferrably bisects the surface 22. As seen in FIG. 2, the direction of travel of the chain is to the left and, in this position the trailing edge 23 of the depth gauge link is behind the line L and spaced forward of the associated cutter or raker link 14, 16. The top surface 22 thus engages and rides along the bottom of the saw kerf and limits the depth of cut of the associated cutter or raker tooth to a predetermined cutting or raking depth as is well known in the art. It will also be noted that, with this configuration, the forward edge 24 of the depth gauge link and the trailing edge 23 are the same radial distance from the center of the rivet which connects the link to the adjacent cutter or raker link. A leading inclined surface 26 extends downwardly and forwardly from the forward edge 24 and a trailing surface 27 extends downwardly away from the trailing edge 23.

As best shown in FIG. 1, the cutter link includes two cutter teeth 28, 29 which extend upwardly and outwardly from two side link elements. The two teeth 28, 29 are mirror images of one another and generally define a V which is wider at its top than the rest of the chain. As seen in FIGS. 1 and 2 the cutter teeth 28, 29 may be formed with a top rake or taper such that the leading edge of each tooth is higher than the trailing edge thereof. The teeth may also be provided with a side taper such that the leading edge of the teeth are spaced farther apart than their trailing edges. The lower portions 31, 32 of the cutter teeth 28, 29 respectively extend forwardly of the associated cutter teeth and form the side connector links which are pivotally connected to the preceeding center mounted depth gauge link 12.

Still referring to FIGS. 1 and 2, each raker link 16 has a single tooth or bit 33 which extends vertically from its center mounted sprocket engaging base and is offset laterally from the centerline of the chain. The upper surface of the raker tooth 33 is generally planar and extends essentially the full width between the inside of teeth 28, 29 of the cutter link 14. The general configuration of the raker tooth is well known in the art and it will be appreciated that the leading edge of the raker tooth 33 may be raked at an angle from the center line of the chain and the upper surface of the tooth may be inclined at an angle such that the leading edge is higher than the trailing edge. The rake angle and the angle of inclination of the top surface may also be varied as discussed in connection with the rake angles of the cutter teeth. As shown in FIG. 1, succeeding raker teeth are formed as mirror images of one another such that the free side edge of the upper surface of the teeth 33 is alternately positioned adjacent the left and right sides of the chain. The lower portion 34 of each raker link extends forwardly of the tooth and forms a center pivotal connection to the preceeding side mounted depth gauge link on one side and an opposed side connector link on the other.

Figure 6:
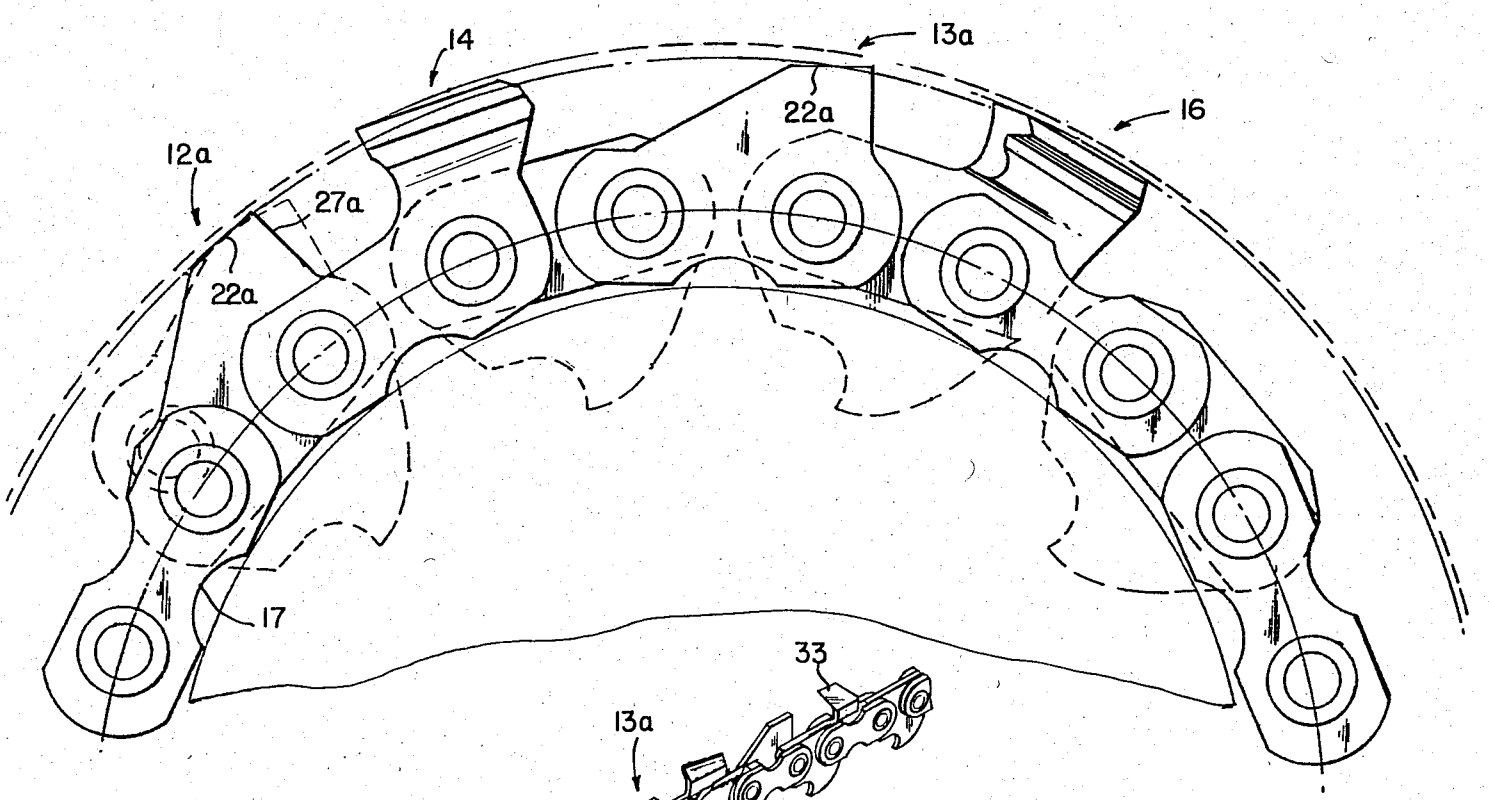
FIG. 6 is a side elevational view of a section of the FIG. 5 embodiment, illustrating the configuration of the links as they pass around the nose of the chain guide bar.
Figure 5:
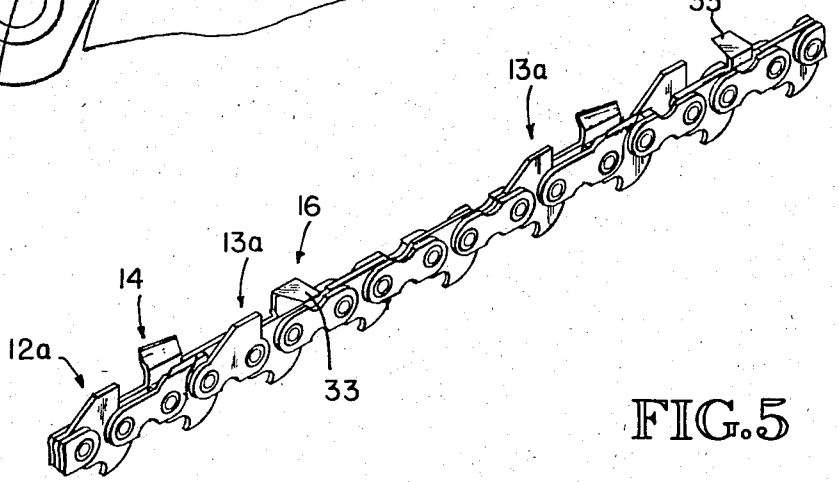
FIG. 5 is a perspective view of a section of saw chain according to a second embodiment of the present invention.
Figure 7:
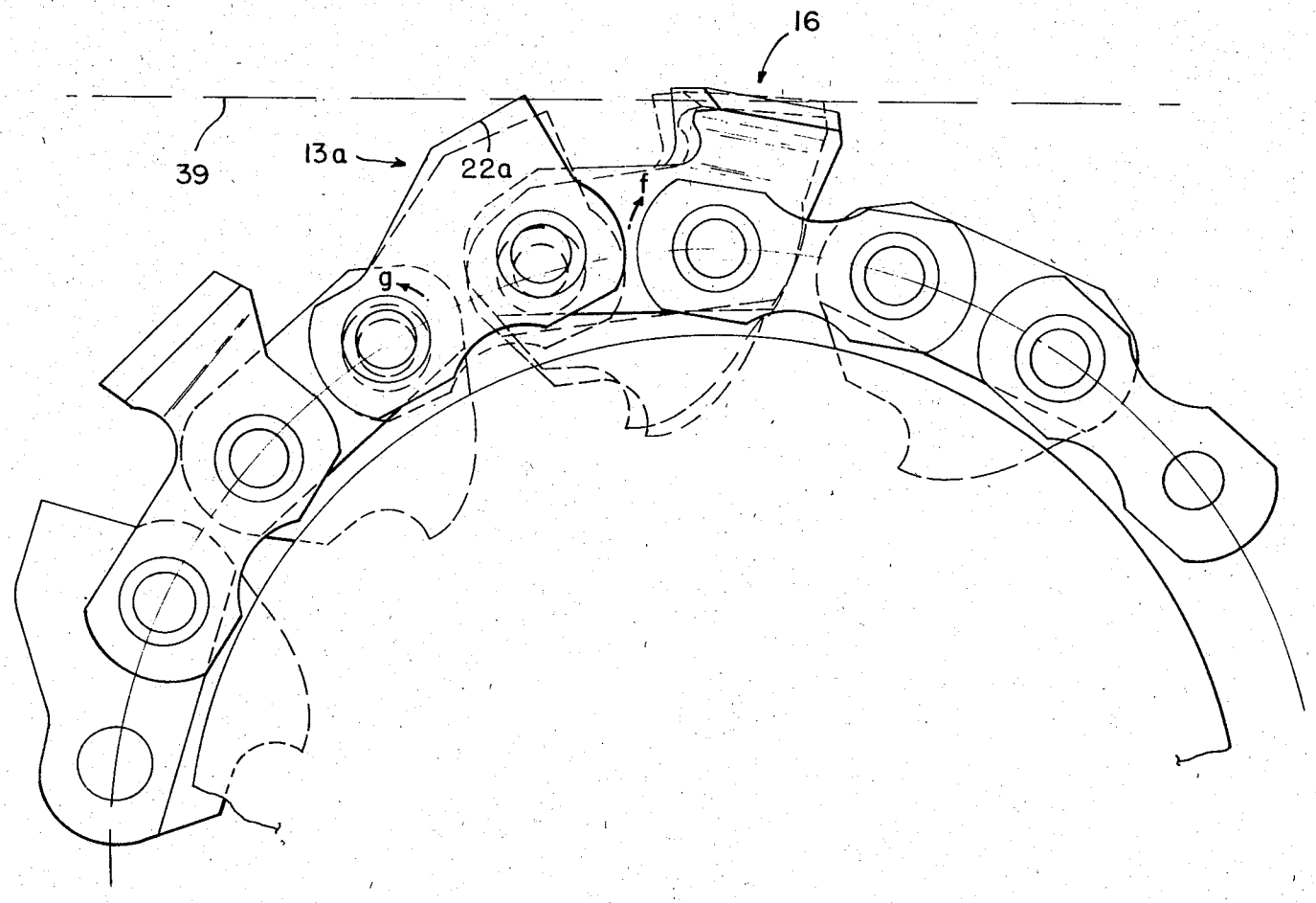
FIG. 7 is a side elevational view of a section of the FIG. 5 embodiment, illustrating the configuration of the links at the initiation of a bore cut into a planar wood face.

FIGS. 5–7 illustrate a second embodiment of the invention utilizing a modified depth gauge configuration for enhanced anti-kickback performance under special cutting conditions. The previously described depth gauge configuration of FIGS. 1–3 dramatically reduces the kickback tendency as compared to prior art saw chains under all operating conditions, however, some amount of "kick" may still result under specialized use. Although not a common occurrence, the occasion does arise when it is necessary to initiate a bore cut into a flat or planar surface such as a saw-cut butt end of a log as illustrated in FIG. 7. When this is attempted there is of course, initially no kerf for the depth gauge to ride in and hence, as the depth gauge and cutter or raker tooth pass around the radius of the bar nose, where the cutting is to occur, the depth gauge which preceeds this cutting tooth drops away leaving the cutting tooth unprotected. The result of course is that the tooth may instantaneously dig excessively into the wood fibre and kick the saw bar upwardly. The harder the particular wood, the more severe this problem becomes. It has been discovered that, by extending the length of the depth gauge surface rearwardly in the direction of the cutting tooth, additional depth gauge protection may be obtained in order to alleviate this condition. It has been found also that the added depth gauge protection may be obtained without appreciably affecting the cutting ability during the normal "bore" cutting once the kerf is formed. FIGS. 5–7 also illustrate a modified arrangement of side link depth gauge mounting which facilitates saw filing when using this extended depth gauge surface.

Referring to FIGS. 5 and 6 the length of the depth gauge surface **22*a* on both center and side mounted links 12*a* and 13*a* respectively, has been extended rearwardly toward the associated cutting tooth. This rearward extension of the depth gauge surface contrasts with the FIGS. 1–3 embodiment wherein the surface 22 is ideally bisected by the line L as previously explained. In practice the depth gauge surface 22*a* has been extended 0.072 inches with good results. The actual limit to which the depth gauge surface may be extended is dictated by the proximity of the adjacent cutting tooth 14 or 16. It is necessary, of course to provide adequate space between the depth gauge trailing surface 27*a* and the cutting tooth to permit filing of the cutting tooth. Although not the case with the center mounted depth gauge link 12*a*, additional space to allow filing of the side mounted depth gauge links 13*a* may be gained by reversing the position of these teeth relative to the associated raker teeth 16. As seen most clearly in FIG. 5, the side mounted depth gauge links are mounted on the side of the chain adjacent the free or extended side edge of the associated raker tooth or bit 33. Because of the angle at which these teeth are filed, additional clearance is obtained for filing by this arrangement. It will be understood that the remaining construction of the chain remains identical to that described in connection with FIGS. 1–3**.

FIG. 6 illustrates the relationship between the various links as the chain operates in a kerf and passes around the radius of the bar nose. As will presently be described with relation to FIG. 6, the break-away or drop-away action of the depth gauge surface and its interaction with the cutting tooth to prevent "kick back" remains identical to that described for the FIGS. 1–3 embodiment. The ability of the depth gauge to avoid digging into the wood surface depends on the initial clockwise rotation of the depth gauge link in its break-away action, hence the rearwardly extended depth gauge surface **22*a*** does not interfere. Further, since the surface is extended in a rearward direction it does not appreciably reduce normal cutting ability on the bar nose.

OPERATION

As previously mentioned, FIG. 2 depicts the orientation of one embodiment of the cutting chain of the present invention along a linear run of the chain with the centers of the rivets in substantial alignment. This cutting mode is encountered when using the chain for a straight cut by applying the rail side (upper or lower) of the chain bar to the work piece. As seen in FIG. 2 the depth gauge links ride in the saw kerf with the flat portions 22 contacting the kerf bottom to apply a predetermined limit to the depth of cut and rake. FIG. 3 on the other hand illustrates the positions of the various links as the chain passes around the radius of the bar nose and the action of the depth gauge of the present invention when an obstacle is encountered. To better understand the problem of the prior art, FIG. 4 is used to contrast the action of one well known prior art integral depth gauge cutter tooth configuration under the same circumstances.

Considering first the saw chain of the present invention as illustrated in FIG. 3, it will be noted that, because of the articulated connection between the depth gauge links and the associated cutter or raker tooth link, a substantial portion of the depth of cut of the cutters and raker 14, 16 is maintained. Stated another way, the difference between the height of the depth gauges and the cutter and raker teeth about the curved path of the kerf is not severely diminished thereby maintaining cutting efficiency about the bar nose such as in "boring". This occurs because the depth gauge links pivot about a different axis than the associated cutter or raker. FIG. 4 illustrates what occurs with the conventional depth gauge and cutter link. In FIG. 4 it may be seen that, due to the curvature of the kerf about the nose of the bar the effective cutting depth, i.e., difference between the height of the depth gauge 36 and the cutter tooth 37 is severely diminished, destroying the cutting efficiency of the chain. This is because the cutting depth is fixed on a straight line such as in straight cutting and, being integral, the depth gauge and cutter tooth pivot about the same axis as the chain traverses the radius of the nose.

FIG. 3 also illustrates the action of the depth gauge of the present invention in the event an obstacle is encountered by the moving depth gauge link. Such an encounter directs a force against the leading inclined surface 26 in the direction of the arrow a causing the depth gauge link to pivot about the axis of the rivet connecting it to the cutter link in the direction of the arrow b. This pivoting moves the depth gauge to the dotted line position illustrated as the chain continues to move. Since the trailing edge 23 of the depth gauge, which is in contact with the kerf bottom, is only slightly forward of the line at right angles to a line passing through the centers of the rivets of the cutter link 14, the trailing edge drops away from the kerf bottom bringing the leading edge 24 into contact with the kerf bottom. Since these two points are the same radial distance from the axis about which the link pivots the depth gauge does not dig in but instead maintains its cutting depth. In the event the obstruction is severe enough to move the depth gauge away from the kerf bottom, pressure will be applied against the forward end of the cutter link in the direction of the arrow c. This force will tend to rock the cutter tooth toward the kerf bottom in the direction of the arrow d causing a momentary digging in of the cutter tooth. Because of the configuration of the cutter link, however, any digging in of the cutter tooth will tend to rotate the cutter link about the axis of its rear pivot in the direction of the arrow e. This will in turn create a counter force in the direction of arrow f to restore the depth gauge link to its operative position, thus avoiding any jamming or locking of the chain and attendant "kickback". The same action, of course, occurs with the raker tooth 16 and its associated depth gauge. Further, the anti kickback action just described will occur on the straight cut as well as with boring or limbing with the bar nose.

The severe problem of kickback experienced with at least one type of prior art depth gauge is illustrated in FIG. 4. The solid line position of the integral depth-gauge cutter-link is that normally maintained about the curvature of the bar nose. The link 38 immediately preceeding the depth gauge 36 and pivotally connected thereto is something termed a "guard" link and is intended to prevent any excess digging in of the depth gauge and cutter tooth. At least on the nose radius, however, an obstacle encountered by the protruding depth gauge 36 will tend to rotate the entire integral cutter link about the axis of the rear rivet and because of the radial distance of the depth gauge from this axis, severe digging in will occur as illustrated by the dotted line position before the guard link 38 encounters the curved bottom of the kerf. In addition, as the depth gauge digs in, the cutter tooth itself is raised to an extremely sharp angle with further forward movement of the chain only tending to dig the depth gauge and cutter tooth into the wood. Both the guard link and the depth gauge have been rendered inoperative, there being no counter balancing forces to dislodge the cutter link. At this point the chain is halted and the entire momentum of the moving chain is transformed into a force which kicks the bar back away from the work piece. It may also be appreciated at this point that the same action occurs on the straight cut and that filing the depth gauge 36 down to increase the depth of cutting about the nose radius enhances the chance of causing the cutter tooth to initiate the action and to solidly dig into the wood fibre.

Referring to the embodiment of FIGS. 5–7, it will be understood that the break-away action of the depth gauge links **12*a* and 13*a* and the resultant rotational and counter rotational forces applied to the depth gauge and cutting links when an obstacle is encountered are identical to that described relative to the FIGS. 1–3 embodiment. Although the surface 22*a* is extended rearwardly, it merely drops away when this link 12*a* or 13*a*** is rotated clockwise. In practice it has been found that with 0.072 inch extension of the depth gauge surface, with the chain configuration illustrated, no appreciable loss of cutting ability at the bar nose is experienced. On the straight cut along the linear run of the chain, of course, the extension has no effect in cutting abililty.

FIG. 7 illustrates the situation wherein boring is initiated into the flat or substantially planar face of a log surface 39 such as a saw-cut butt end. Since there is initially no kerf, the depth gauge link **13*a* and cutting link 16 are in the dotted line positions shown. At the moment the cutting tooth starts to enter the wood surface the depth gauge link is completely out of contact with the wood surface leaving the cutting tooth unprotected and free to dig excessively into the wood fibre. In order to prevent a mild "kick" at this point, the extended depth gauge surface 22*a* comes into play. As the cutting tooth enters the wood fibre it is "upset" or rotated in the clockwise direction about its rear pivot as indicated by the arrow f in FIG. 7. This rotation serves to lift the rear end of the depth gauge link 13*a* upwardly as the link is rotated about is forward pivot as indicated by the arrow g. Because of the rearwardly extended surface 22*a***, the trailing edge of this depth gauge surface is caused to momentarily contact the wood surface and limit the depth of penetration of the cutting tooth. Any tendency for the chain saw to "kick" is thus avoided. The greater the rearward extension of the depth gauge surface, the less chance there will be for "kick" but, as the bore progresses, cutting ability will be progressively affected the more the depth gauge surface is extended.

What is claimed is:

1. In a saw chain, the combination comprising;

a cutting link pivotally connected to succeeding chain links at a first pivot point, a depth gauge link pivotally connected to said cutting link at a second pivot point and to a preceeding chain link at a third pivot point, said depth gauge link including a kerf engaging depth gauge surface on the top side thereof for limiting the depth of cut of said cutting link to a predetermined depth, said depth gauge surface extending a distance less than the distance between said second and third pivot points and located such that a straight line passing through said second pivot point and normal to a straight line passing through said second and third pivot points passes through the depth gauge surface.

2. The combination according to claim 1 wherein, said normal line passes through the approximate mid point of said depth gauge surface and said depth gauge surface includes a trailing edge, relative to the cutting direction of the chain, and said cutting link includes a cutting tooth, said trailing edge being located forward of said cutting tooth.

3. The combination according to claim 1 wherein, said normal line passes through said depth gauge surface at a point where the major portion of said surface is located rearwardly thereof in the direction of travel of the chain and said depth gauge surface includes a trailing edge, and said cutting link includes a cutting tooth, said trailing edge being located forward of said cutting tooth.

4. The combination according to claim 2 wherein, said trailing edge is located rearward of a second line passing through said second pivot point and normal to a straight line passing through said first and second pivot points when the pivot points of the chain links are aligned for straight cutting and being located forward of said second normal line when the chain is passed about the radius of a saw bar.

5. The combination according to claim 3 wherein, said trailing edge is located rearwardly of a second line passing through said second pivot point and normal to a straight line passing through said first and second pivot points when the pivot points of the chain links are aligned for straight cutting and when the chain is passed about the radius of a saw bar.

6. The combination of claim 4 wherein, said depth gauge surface is substantially flat and further includes a leading edge, said trailing edge and said leading edge being the same approximate radial distances from the center of said second pivot point.

7. The combination of claim 6 wherein, said depth gauge link includes an inclined surface extending downwardly and forwardly from said leading edge, whereby an obstacle engaging said inclined surface will cause said depth gauge link to pivot clockwise about said second pivot point so as to drop said depth gauge surface away from the kerf bottom.

8. The combination according to claim 3 wherein, said depth gauge link includes an inclined surface extending downwardly and forwardly from said leading edge, whereby an obstacle engaging said inclined surface will cause said depth gauge link to pivot clockwise about said second pivot point so as to drop said depth gauge surface away from the kerf bottom.

9. The combination according to claim 7 wherein, said cutting tooth is located rearward of said second pivot point, whereby a force tending to move said depth gauge link away from the kerf bottom forces said cutting tooth into engagement with the kerf bottom resulting in a counter moment tending to rotate said cutting link in a clockwise direction about said first pivot point to restore said depth gauge against the kerf bottom.

10. The combination according to claim 8 wherein, said cutting tooth is located rearwardly of said second pivot point, whereby a force tending to move said depth gauge link away from the kerf bottom forces said cutting tooth into engagement with the kerf bottom resulting in a counter moment tending to rotate said cutting link in a clockwise direction about said first pivot point to restore said depth gauge against the kerf bottom.

11. The combination according to claim 2 wherein, said depth gauge link is a center mounted link and said cutting link comprises first and second side link elements pivotally connected to said depth gauge link.

12. The combination according to claim 3 wherein, said depth gauge link is a center mounted link and said cutting link comprises first and second side link elements pivotally connected to said depth gauge link.

13. The combination according to claim 2 wherein, said depth gauge link is a side mounted link and said cutting link comprises a center mounted link pivotally connected to said depth gauge link.

14. The combination according to claim 3 wherein, said depth gauge link is a side mounted link and said cutting link comprises a center mounted link pivotally connected to said depth gauge link.

15. In a saw chain, the combination comprising;

a depth gauge link adapted for pivotal connection to a succeeding cutting link having a cutting tooth carried thereby, said depth gauge including a kerf engaging depth gauge surface spaced forwardly of an adjacent cutting tooth for limiting the depth of cut thereof, and means pivotally connecting said depth gauge link to said cutting link with said kerf engaging depth gauge surface being so located as to be dropped away from the bottom of a kerf when said depth gauge link encounters an obstacle tending to rotate said link in a clockwise direction.

16. The combination according to claim 15 wherein;

at least the major portion of said depth gauge surface is located rearwardly of the pivotal connection between said depth gauge link and said cutting link in the direction of travel of the chain when said saw chain is in a straight line configuration.

17. The combination according to claim 16 wherein;

said cutting link is pivotally connected to succeeding links at a first pivot point, said pivotal connection between said cutting link and said depth gauge link comprises a second pivot point, said depth gauge link is pivotally connected to a preceding link at a third pivot point, and said at least a major portion of said depth gauge surface is located rearwardly of a straight line passing through said second pivot point and normal to a straight line passing through said second and third pivot points, whereby said at least a major portion of said depth gauge link is so related to said cutting tooth and said second pivot as to be dropped away from the bottom of a kerf when said depth gauge link encounters an obstacle tending to rotate said link in a clockwise direction.

18. The combination according to claim 17 wherein; said depth gauge surface includes a trailing edge, said trailing edge being located forward of said cutting tooth.

19. The combination according to claim 18 wherein; said depth gauge surface is substantially flat and includes a leading edge thereon, and an inclined surface extending downwardly and forwardly from said leading edge, whereby an obstacle engaging said inclined surface will cause said depth gauge link to pivot clockwise about said second pivot point so as to drop said depth gauge surface away from the kerf bottom.

20. The combination according to claim 19 wherein; said cutting tooth is located rearwardly of said second pivot point, whereby a force tending to move said depth gauge link away from the kerf bottom forces said cutting tooth into engagement with the kerf bottom resulting in a counter moment tending to rotate said cutting link in a clockwise direction about said first pivot point to restore said depth gauge against the kerf bottom.

21. The combination according to claim 20 wherein; said depth gauge link is a center mounted link and said cutting link includes a side link element pivotally connected to said depth gauge link.

22. The combination according to claim 20 wherein; said depth gauge link is a side mounted link and said cutting link comprises a center mounted link pivotally connected to said depth gauge link.

* * * * *